US005568883A

United States Patent [19]

Cataneo et al.

[11] Patent Number: 5,568,883

[45] Date of Patent: Oct. 29, 1996

[54] APPARATUS FOR DISPENSING TWO FLOWABLE SUBSTANCES IN A USER SELECTABLE RATIO

[75] Inventors: Ralph J. Cataneo, Brooklyn, N.Y.; Robert J. Tannebaum, Freehold, N.J.

[73] Assignee: Innavision Services, Inc., Clifton, N.J.

[21] Appl. No.: 419,316

[22] Filed: Apr. 10, 1995

[51] Int. Cl.[6] ..... B67D 5/52

[52] U.S. Cl. ..... 222/136; 222/145.8; 222/256; 222/387

[58] Field of Search ..... 222/134, 136, 222/144.5, 145.7, 145.8, 145.4, 256–260, 321.7, 321.8, 383.1, 386, 387, 389, 505, 517, 340

[56] References Cited

U.S. PATENT DOCUMENTS

| | | | |
|---|---|---|---|
| 1,667,818 | 5/1928 | Lincoln | 222/144.5 |
| 3,760,986 | 9/1973 | Castner et al. | 222/137 |
| 3,876,112 | 4/1975 | Kramer | 222/132 |
| 4,271,984 | 6/1981 | Ducros et al. | 222/94 |
| 4,335,837 | 6/1982 | Bono | 222/137 |
| 4,549,674 | 10/1985 | Alticosalian | 222/48 |
| 4,629,097 | 12/1986 | Moore | 222/260 |
| 4,687,663 | 8/1987 | Schaeffer | 424/52 |
| 4,691,847 | 9/1987 | Ford et al. | 222/259 |
| 4,771,919 | 9/1988 | Ernst | 222/134 |
| 4,830,221 | 5/1989 | Mazzanobile | 222/260 |
| 4,838,457 | 6/1989 | Swahl et al. | 222/48 |
| 4,884,703 | 12/1989 | O'Meara | 215/6 |
| 4,893,729 | 1/1990 | Iggulden et al. | 222/42 |
| 5,000,355 | 3/1991 | Pritchard | 222/256 |
| 5,385,270 | 1/1995 | Cataneo et al. | 222/134 |

FOREIGN PATENT DOCUMENTS

| | | |
|---|---|---|
| 629854 | 5/1936 | Germany . |
| 910791 | 11/1962 | United Kingdom . |
| 2064664 | 6/1981 | United Kingdom . |

*Primary Examiner*—Andres Kashnikow
*Assistant Examiner*—Philippe Derakshani
*Attorney, Agent, or Firm*—Panitch Schwarze Jacobs & Nadel, P.C.

[57] ABSTRACT

An apparatus for dispensing two flowable substances in a user-selectable ratio. The dispensing apparatus includes first and second containers for receiving flowable substances. Each container has a dispensing end and a second end which initially includes a piston, which is moveable only toward the dispensing end as the substances are dispensed. The dispensing apparatus also includes a manifold member having an inlet with a pair of inlet openings for removably receiving the containers. The manifold member is internally divided into two chambers for receiving the respective flowable substances. A pump member, which is moveable with respect to the manifold chamber, having an inlet end in fluid communication with the manifold chambers is provided. A selector member with a single opening is provided in fluid communication with the outlet end of the manifold member. Upon movement of the pump member by a user in a first direction from its initial position with respect to the manifold member, a predetermined measure of flowable substance is dispensed from the apparatus. The ratio of the dispensed substances is user variable from 100% of the first flowable substance and 0% of the second flowable substance when the selector member is in the first position, to 0% of the first flowable substance and 100% of the second flowable substance when the selector member is in the second position, to any desired ratio there between when the selector member is in an intermediate position.

18 Claims, 3 Drawing Sheets

APPARATUS FOR DISPENSING TWO FLOWABLE SUBSTANCES IN A USER SELECTABLE RATIO

FIELD OF THE INVENTION

The present invention relates to an apparatus for co-dispensing two flowale substances, and more particularly, to a dispenser for holding, selecting and co-dispensing a mixture of two flowable substances in a user selectable ratio.

BACKGROUND OF THE INVENTION

In certain consumable product applications, it is desirable to include two different flowable substances. In hair care products, such as shampoos and conditioners, the shampoo and conditioning substances are mixed in a predetermined ratio and packaged in a single cavity container. In other applications, containers having two cavities are used to keep the substances separate until they are dispensed. For example, certain toothpastes include both a gel substance and; a paste substance which are stored in separate cavities in the container and are co-dispensed.

Dispensing units having multiple chambers for holding different flowable substances are generally known. In one prior art dispenser, the flowable substances are stored in separate compressible chambers within a container, each chamber being provided with a dip tube. Secured to the top of the container is a metering and mixing output section. A metering mechanism includes a shaft on which a series of cams are mounted and a selector dial coupled to the shaft which function as a control element to rotate the cams. Each cam is arranged in the course of rotation to more or less pinch a respective dip tube, thereby determining the volume of constituent flow from each of the chambers into the output section.

Another prior art dispenser for holding, metering, mixing and dispensing a mixture of two substances comprises a container having two compartments for containing the two substances and a cylindrical neck at the top of the container having a first bore and a second bore, each communicating with a respective chamber in the container. A cylindrical mixing chamber communicating with the first and second bores is disposed over the cylindrical neck and includes a third bore on a top-end, thereof, for the egress of the two substances. The dispenser also includes a selector dial having a central opening concentrically disposed over the first bore for dispensing the substance from one of the compartments. A plurality of various diameter metering openings are disposed peripherally around the selector dial, concentrically disposed to pass over the second bore as the selector dial is rotated so that the substance from the other compartment is adjustable.

A third prior art dispenser comprises a cylindrical housing having a dispensing and a storage chamber enclosing a pair of containers for receiving flowable substances which are removably mounted on a mounting block. The block is provided with a pair of openings on an annular surface having a central projection about which a selector dial rotates. The projection includes a pair of passageways in fixed alignment with the openings so as to conduct a flowable substance therethrough. A regulating disk, including a plurality of different-sized openings, is movably disposed on the annular surface for revolving about the projection. When the regulating disk is moved in response to rotation of the selector, a selected disk opening is placed in registry between a block opening and a respective passageway, permitting the flowable substance within each container to pass into a blending relationship at the dispensing end.

The above-mentioned prior art dispensers provide metering by means of varying the openings of the chambers disposed within the container by means of a dial-valve or regulating disk to restrict the flow of material, and thereby alter the proportions of liquid by means of the restriction. These dispensers have erred in their conception that the substances are dispensed by exerting equal pressure on the compressible chambers within the compressible outer container. The results of applying pressure as described when holes are close in diameter does not result in altering the volume of the material extruded through the holes in any predictably variable way other than as a function of the amount of pressure exerted. Another disadvantage of the prior art dispensers is that they all employ a relatively complex structure involving relatively high manufacturing costs.

The present invention overcomes many of the disadvantages inherent in the above-described prior art dispensers by providing an apparatus for dispensing two flowable substances in a user selectable ratio in which the flow volume is varied by a selector member having a single opening. The dispensing apparatus includes a first container for receiving a first flowable substance, with the first container having a uniform cross-section and having a first, generally open dispensing end, and a second end which initially includes a piston. The piston is movable only toward the dispensing end of the first container as the flowable substance flows out of the dispensing end. The apparatus also includes a second container for receiving a second flowable substance, with the second container having a uniform cross-section including a first, generally open dispensing end, and a second end which initially includes a piston. The piston is movable only toward the dispensing end of the second container as the second flowable substance flows out of the dispensing end. The dispensing ends of the first and second containers are removably received in the inlet end of a manifold member. The manifold member has an inlet end and an outlet end, and a pair of inlet openings. The manifold member is internally divided into two chambers. The first chamber is in fluid communication with the dispensing end of the first container, for receiving the first flowable substance, and the second chamber is in fluid communication with the dispensing end of the second container, for receiving the second flowable substance. The outlet end of the manifold member has a pair of outlet openings corresponding to the inlet openings so that the first and second flowable substances from the first and second containers flow into the respective inlet opening, through the respective chambers and out of the respective outlet openings of the manifold member. The dispensing apparatus also includes a pump member having an inlet end, in fluid communication with the first and second manifold chambers, and an outlet end. The pump member is movable with respect to the manifold member. A selector member is in fluid communication with outlet end of the manifold member. The selector member has a single opening of a predetermined size extending therethrough. The selector member is selectably rotatable with respect to the outlet end of the manifold member from a first position, in which the selector member opening is in fluid communication with the outlet of the first chamber of the manifold member, with the outlet of the second chamber of the manifold member being blocked by the selector member, through a plurality of intermediate positions, in which the opening of the selector member is in fluid communication with portions of the outlets of both of the manifold member chambers, with the remaining portions of the outlets of both of the manifold member chamber being blocked by the selector member, to a second position, in which the opening of the selector member is in fluid communication with the outlet of the second chamber of the manifold member and the outlet of the first chamber of the manifold member is blocked by the selector member. A single dispenser outlet opening is provided in communication with the selector member. Upon movement of the pump member by a user, a predetermined measure of flowable substance is dispensed from the apparatus with the ratio of the flowable substance being selectively variable by the user from 100% of the first flowable substance and 0% of the second flowable substance, when the selector member is in the first position, to 0% of the first flowable substance and 100% of the second flowable substance, when the selector member is in the second position, through a plurality of intermediate positions providing varying ratios of the first and second flowable substances.

SUMMARY OF THE INVENTION

Briefly stated, the present invention comprises an apparatus for dispensing two flowable substances in a user-selectable ratio. The dispensing apparatus comprises a first container for receiving a first flowable substance, with the first container having a uniform cross-section and including a first, generally open dispensing end, and a second end which initially includes a piston. The piston is moveable only toward the dispensing end as the first flowable substance flows out of the dispensing end. The dispensing apparatus also includes a second container for receiving a second flowable substance, with the second container having a uniform cross-section and including a first, generally open dispensing end, and a second end which initially includes a piston. The piston is movable only toward the dispensing end as the second flowable substance flows out of the dispensing end. The dispensing apparatus further includes a manifold member having an inlet end and an outlet end, with the inlet end having a pair of inlet openings for removably receiving the dispensing ends of the first and second containers. The manifold member is internally divided into two chambers, with a first chamber being in a fluid communication with the dispensing end of the first container, for receiving the first flowable substance, and a second chamber being in fluid communication with the dispensing end of the second container, for receiving the second flowable substance. The outlet end has a pair of outlet openings corresponding to the inlet openings so that the first and second flowable substances from the first and second containers flow into their respective inlet opening, through the respective chambers and out of the respective outlet openings of the manifold member.

The dispensing apparatus further includes a pump member having an inlet end in fluid communication with the first and second manifold chambers. The pump member also has an outlet end. The pump member is moveable with respect to the manifold member. A selector member is provided in fluid communication with the outlet end of the manifold member. The selector member has a single opening of a predetermined size and a predetermined shape extending therethrough. The selector member is selectably rotatable with respect to the outlet end of the manifold member from a first position, in which the selector member opening is in fluid communication with the first chamber of the manifold member, with the outlet of the second chamber of the manifold member being blocked by the selector member, through a plurality of intermediate positions, in which the opening of the selector member is in fluid communication with portions of the outlets of both of the manifold chambers, with the remaining portions of the outlets of both of the manifold member chambers being blocked by the selector member, to a second position, in which the opening of the selector member is in fluid communication with the outlet of the second chamber of the manifold member, and the outlet of the first chamber of the manifold member is blocked by the selector member. The dispensing apparatus includes a single dispenser outlet opening in communication with the selector member.

Upon movement of the pump member by a user in a first direction from its initial position with respect to the manifold member, a predetermined measure of flowable substance is dispensed from the apparatus. The ratio of the flowable substance which constitutes the predetermined measure being selectively variable by the user from 100% of the first flowable substance and 0% of the second flowable substance when the selector member is in the first position, to 0% of the first flowable substance and 100% of the second flowable substance when the selector member is in the second position, to any desired ratio there between when the selector member is in an intermediate position. Upon movement of the pump member in a second direction with respect to the manifold member, opposite to the first direction, one or both of the pistons are moved to cause one or both flowable substances to flow into the respective manifold member chambers to thereby fill both of the manifold member chambers with the respective flowable substances.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
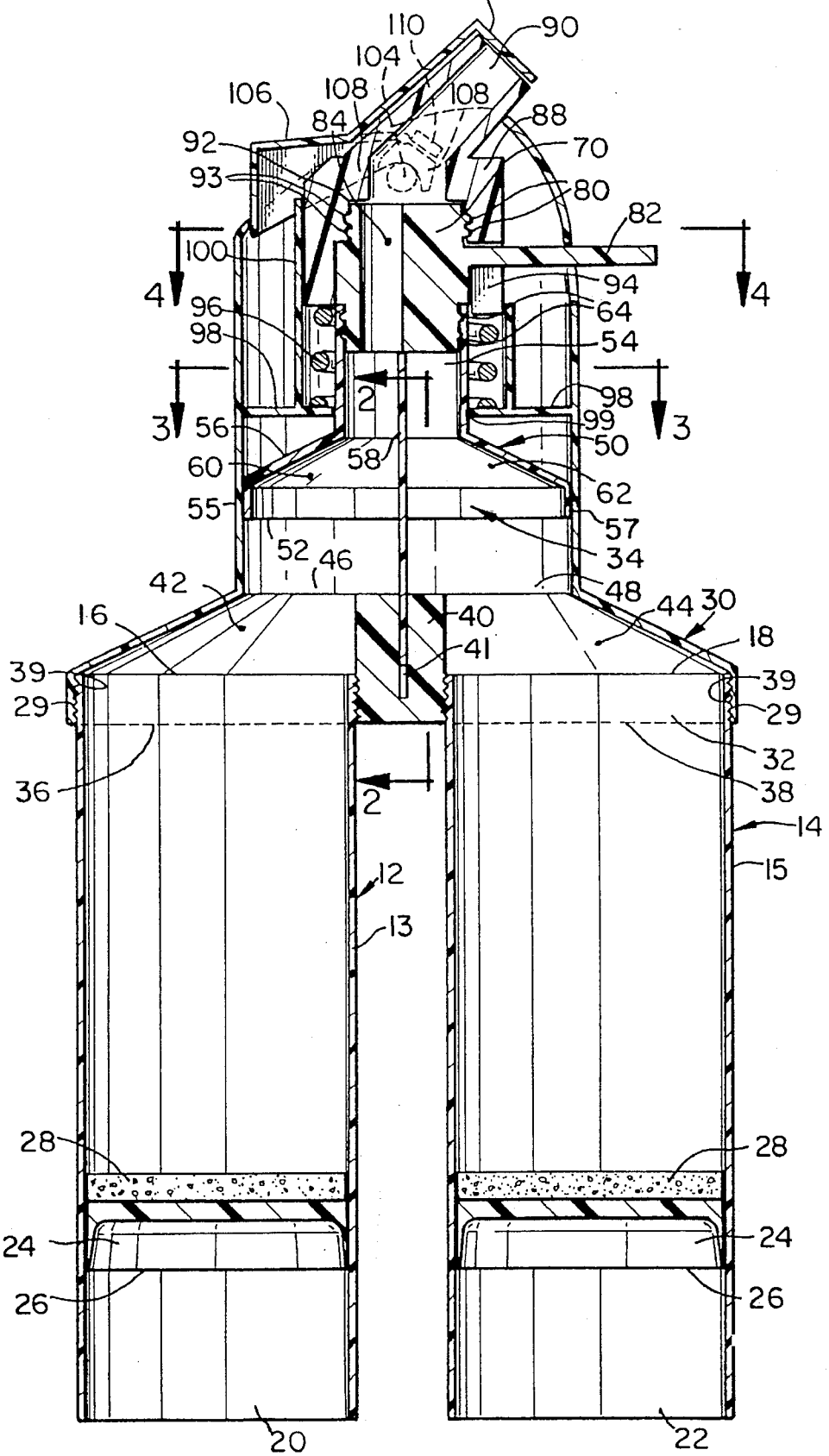
FIG. 1 is a section view of an apparatus for dispensing two flowable substances in a user selectable ratio in accordance with a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the apparatus for dispensing™ two flowable substances in a user selectable ratio and designated parts thereof. The terminology includes the words above specifically mentioned, derivatives thereof and words of similar import.

Referring to the drawings, wherein like numerals indicate like elements throughout, there is shown in FIGS. 1–5, a preferred embodiment of an apparatus for dispensing two flowable substances in a user selectable ratio, generally designated 10, (hereinafter the "dispenser" 10) in accordance with the present invention.

Referring to FIG. 1, the dispenser 10 is comprised of a first container 12 for receiving a first flowable substance (not shown) and a second container 14 for receiving a second flowable substance (not shown). The first and second flowable substances are preferably a high viscosity gel or paste, such as toothpaste or a hair styling gel. The first and second containers include walls 13 and 15 respectively, which are configured to provide a uniform container cross-section and include first, generally open dispensing ends, 16 and 18 respectively, and second ends, 20 and 22 respectively, which initially include pistons 24. The pistons 24 are moveable only toward the dispensing ends 16 and 18 as the flowable substances flow out of the dispensing ends 16 and 18 of the containers 12 and 14, respectively.

Preferably, the first and second containers 12 and 14 are generally cylindrical, are made of a polymeric material and include external threads 29 around the periphery of the dispensing ends 16 and 18. However, it is understood by those skilled in the art that the cross-section of the containers 12 and 14 can vary, if desired, for particular applications. For example, the containers could be parallelepiped or semi-cylindrical such that when assembled they provide the external appearance of a single cylinder. Similarly, the containers 12 and 14 may be made of other suitable materials, for example a coated paper or lined card board, or a suitable metal.

In the preferred embodiment, each piston 24 has a sealing flange 26 around its periphery which contacts the respective container wall 13 and 15. The sealing flange 26 is configured so that the resistance to move down in the container 12 or 14 is much greater than the resistance to move upward toward the dispensing ends 16 and 18 of the containers 12 and 14 respectively. A series of spaced annular ribs (not shown) may be provided along the interior surface of the container walls 13 and 15 to help prevent movement of the pistons 24 away from the dispensing ends 16 and 18 of the containers 12 and 14. Preferably, a compressible pad 28 is affixed to the top of each piston 24.

In the preferred embodiment, the pistons 24 are molded from a polymeric material such as polypropylene. The sealing flange 26 of each piston 24 may also include barbs (not shown) to substantially increase the resistance for moving the pistons 24 back toward the second ends 20 and 22 of the containers 12 and 14. Preferably, the compressible pads 28 are made of a polyurethane closed cell-foam material, and have a compressible volume equal to approximately 50% of the displacement of the pump actuator 56, as will be explained below.

Still with reference to FIG. 1, a manifold member 30 having an inlet end 32 and an outlet end 34 is shown. The inlet end 32 includes a pair of inlet openings 36 and 38 for removably receiving the dispensing ends 16 and 18 of the first and second containers 12 and 14, respectively. The inlet openings 36 and 38 preferably include internal threads 39 for removably engaging the external threads 29 on the first and second containers 12 and 14.

The manifold member 30 is internally divided into two chambers 42 and 44 by a divider 40 which includes a slot 41. The first chamber 42 is in fluid communication with the dispensing end 16 of the first container 12 for receiving the first flowable substance. The second chamber 44, formed by the divider 40, is in fluid communication with the dispensing end 18 of the second container 14 for receiving the second flowable substance. The outlet end 34 of the manifold member 30 has a pair of outlet openings 46 and 48 corresponding to the inlet openings 36 and 38 respectively, so that the first and second flowable substances from the first and second containers, 12 and 14 respectively, flow into the respective inlet openings 36 and 38 respectively, through the respective chambers 42 and 44 and out of the respective outlet openings 46 and 48 of the manifold member 30.

Preferably, the manifold member 30 is formed from a polymeric material. In the preferred embodiment, the manifold member 30 has a generally oval shaped inlet end 32, to accommodate the two cylindrical containers 12 and 14, and transitions to a generally circular outlet end 34. However, it is understood by those skilled in the art from the present disclosure, that the manifold 30 may be made of other suitable materials such as machined or cast metal, and may have various shapes to suit particular container shapes. Additionally, the attachment system between the containers 12 and 14 and the manifold member 30 may be varied. For example, the dispensing ends of the containers 12 and 14 could include a raised lip (not shown) which snaps into a corresponding groove (not shown) in the manifold member 30, or separate couplings (not shown) could be utilized to removably attach the containers 12 and 14 to the manifold member 30.

Figure 2A:
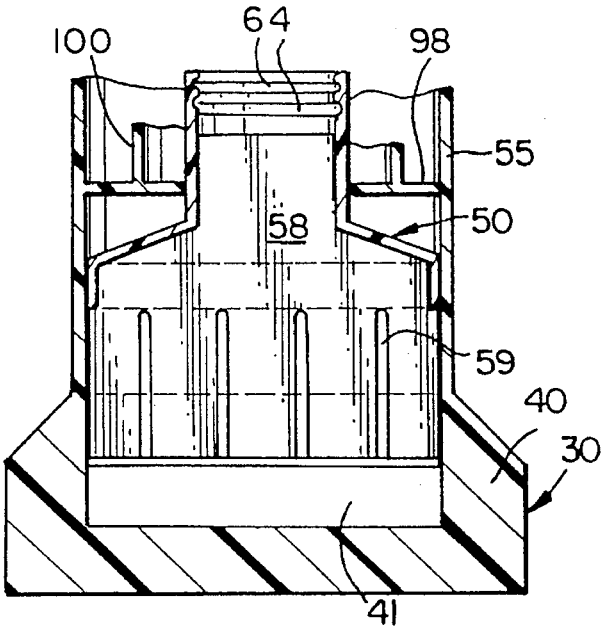
FIG. 2*a* is a partial section view of the dispensing apparatus of FIG. 1 taken along line 2—2 in FIG. 1.
Figure 2B:
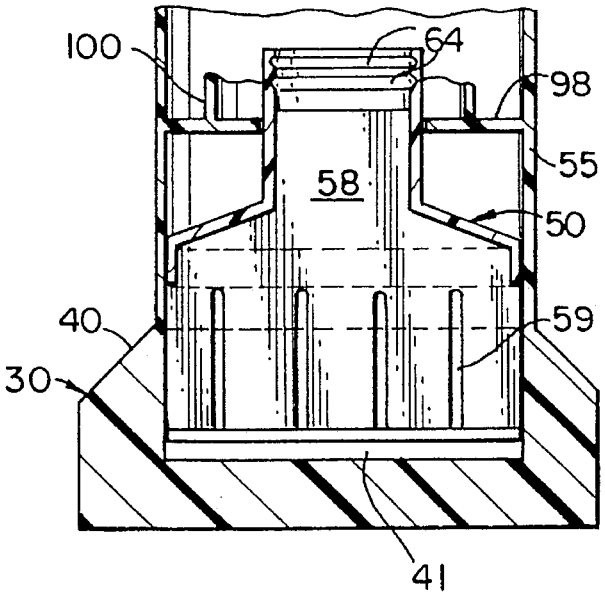
FIG. 2*b* is a partial section view similar to FIG. 2*a* taken along line 2—2 in FIG. 1.
Figure 3:
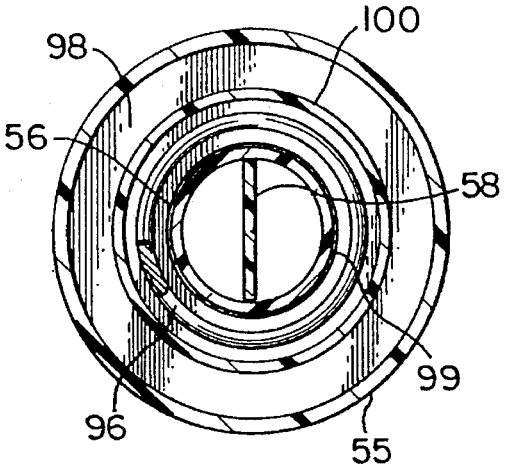
FIG. 3 is a section view of the dispensing apparatus of FIG. 1 taken along line 3—3 in FIG. 1.

Referring to FIGS. 1, 2*a* and 2*b*, a pump member 50 is shown in detail. The pump member 50 includes an inlet end 52 in fluid communication with the outlet end 34 of the manifold member 30, and an outlet end 54. Two sealing groves 64 are formed along the inner surface of the outlet end 54 of the pump member 50. The pump member 50 includes a funnel-shaped actuator 56 having a sealing flange 57 around its periphery. The actuator 56 is located in a circular housing 55 with the sealing flange 57 contacting the inside of the housing 55. As the pump actuator 56 is moved from an initial, rest position, shown in FIG. 2*a*, to the dispensing position, shown in FIG. 2*b*, it produces a volumetric displacement. The volumetric displacement of the pump member 50 is a function of the actuator diameter, the vertical travel and the size of the outlet opening 54.

The pump member 50 further includes a pump divider 58 located in the pump actuator 56 which divides the pump actuator 56 into first and second portions 60 and 62, respectively. The pump divider 58 extends below the pump actuator 56 and is slidably disposed in the slot 41 in the divider 40 of the manifold member 30 to maintain the barrier between the first and second flowable substances in the first and second manifold chambers 42 and 44. Vertically extending grooves 59 are provided in the divider 58.

Preferably, the pump actuator 56 and the divider 58 are molded as a unitary structure from a polymeric material. However, it is understood by those skilled in the art the pump actuator 56 could be made of other materials, such as metal, and could be machined or molded. Similarly, it will be appreciated by those skilled in the art from the present disclosure that the shape and size of the pump member 50 can be varied, as desired, to produce a desired volumetric displacement.

Preferably, the pump housing 55 is formed as a unitary structure with the manifold member 30 from a polymeric material. However, it is similarly understood that the pump housing 55 can be made from other materials, such as metal, and may be machined, cast or formed by any other suitable means. Additionally, the pump housing 55 can be made as a separate piece and be attached to the manifold member 30 in a subsequent operation.

Figure 5:
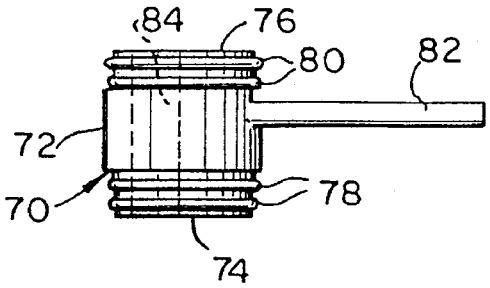
FIG. 5 is a detailed elevational view of a preferred embodiment of the selector member.

Referring now to FIGS. 1 and 4–5, a selector member 70 is provided in fluid communication with the outlet end 34 of the manifold member 30. Fluid communication between the selector member 70 and the manifold member 30 is provided through the first and second portions 60 and 62 of the pump member 50. As described above, the first and second portions 60 and 62 of the pump member 50 are in fluid communication with the outlet openings 46 and 48 respectively, of the manifold member 30.

As shown in detail in FIGS. 1 and 5, the selector member 70 includes a generally cylindrically body 72 having an inlet end 74 and an outlet end 76. Annular sealing rings 78 and 80 are located around the body 72 adjacent to the inlet end 74 and the outlet end 76 respectively.

The selector member 70 has a single opening 84 of a predetermined size and a predetermined shape extending therethrough. As shown in FIGS. 4 and 5, in the present embodiment, a semi-cylindrical opening 84 is defined through the body 72 of the selector member 70. A lever 82 is affixed to and extends from the body 72 of the selector member 70.

Preferably, the selector member 70 is molded as a single piece, including the sealing rings 78 and 80, from a polymeric material. However, it is understood by those skilled in the art that the selector member 70 can be made without sealing rings, and separate O-rings can be used. Additionally, the shape of the opening 84 can be varied to other configurations, such as a square opening.

Referring again to FIG. 1, the selector member 70 is rotatably installed in the outlet end 54 of the pump member 50 with the annular sealing rings 78 located in the grooves 64 (shown in detail in FIGS. 2*a*, 2*b* and 5), and the top of the pump divider 58 is in slidable contact with the inlet end 74 of the selector member 70.

Figure 4A:
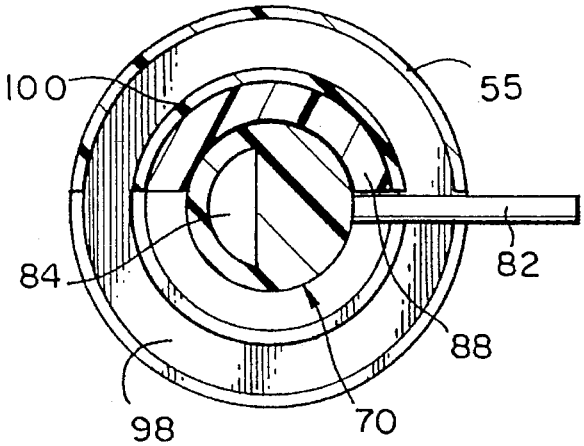
FIG. 4*a* is a section view of the dispensing apparatus of FIG. 1 taken along line 4—4 in FIG. 1.
Figure 4C:
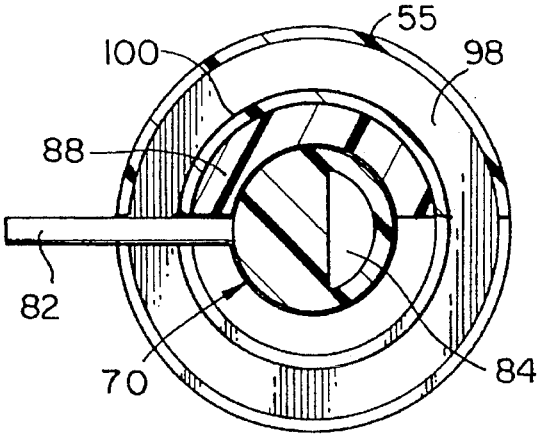
FIG. 4*c* is a section view similar to FIG. 4*a* taken along line 4—4 in FIG. 1.
Figure 4B:
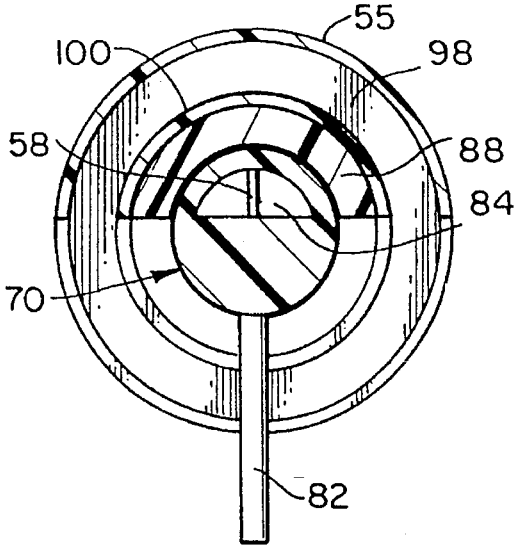
FIG. 4*b* is a section view similar to FIG. 4*a* taken along line 4—4 in FIG. 1.

As shown in FIGS. 4*a–c*, the selector member 70 is selectably rotatable with respect to the outlet end 34 of the manifold member 30 from a first position, as shown in FIG. 4*a*, in which the selector member opening 84 is in fluid communication with the outlet 46 of the first chamber 42 of the manifold number 30, with the outlet 48 of the second chamber 44 of the manifold member 30 being blocked by the selector member 70. The selector member 70 can be moved through a plurality of intermediate positions, such as shown in FIG. 4*b*, in which the opening 84 of the selector member 70 is in fluid communication with portions of the outlets 46 and 48 of both the manifold chambers 42 and 44 respectively, with the remaining portions of the outlets 46 and 48 of the manifold chambers 42 and 44 respectively, being blocked by the selector member 70. The selector member 70 is rotatable to a second position as shown in FIG. 4c, in which the opening 84 of the selector member 72 is in fluid communication with the outlet 48 of the second chamber 44 of the manifold member 30 and the outlet of the first chamber 42 of the manifold member 30 is blocked by the selector member 70.

A dispensing body 88, having a single dispenser outlet opening 90 is provided in communication with the selector member 70. The dispensing body 88 has a bore 92 with sealing grooves 93 located therein. A slot 94 is defined through the dispensing body 88 and intersects the bore 92. The selector member 70 is rotatably installed in the bore 92, with the sealing rings 80 on the selector member 70 being located the grooves 93, and the handle 82 extending through the slot 94.

Preferably, the dispensing body 88 is made from a polymeric material. However, it is understood by those skilled in the art from the present disclosure that the dispensing body 88 can be made from various other suitable materials, such as metal, and can be made by any suitable method, such as machining or molding. Preferably, the dispenser outlet opening 90 is circular. However, the configuration of the dispenser outlet opening 90 can be varied to suit particular applications. For example, the dispenser opening 90 can be flattened, so that a flattened mass of the first and second flowable substances is dispensed.

Referring to FIG. 1, a spring 96 is located between the dispensing body 88 and a support platform 98, affixed to the inside of the pump housing 55, and acts as a biasing member for biasing the pump member 50 toward an initial, rest position, as shown in FIG. 1. An opening 99 is provided in the support platform 98 to allow movement of the upper end of the pump member 50. A cylindrical guide member 100, having an inner diameter which is slightly greater than the outer diameter of the dispensing body 88, is affixed to the support platform 98. The spring element 96 and the dispensing body 88 are maintained in alignment by the guide member 100.

In the preferred embodiment, the spring 96 is a coil spring made from spring steel. However, it is understood by those skilled in the art from the present disclosure that various types of spring elements made from plastic or other suitable materials may be used to bias the pump member toward an initial, rest position, depending on the particular application. Preferably, the support platform 98 and the guide member 100 are molded from a polymeric material as a unitary structure with the pump housing 55 and the manifold member 30. However, it is understood by those skilled in the art from the present disclosure that the support platform 98 and the guide member 100 may be made of any suitable material, such as aluminum or other metals, and may be made separately and be joined in subsequent operations. Additionally, the shape of the support platform 98 may be varied to fit various pump housing configurations.

A pivoting cap member 102 is mounted for pivotal movement on pivot posts 104 affixed on opposing sides of the dispenser outlet dispensing body 88. The cap member 102 is mounted for movement between a first, closed position, as shown in FIG. 1, where it blocks the dispenser outlet opening 90 and a second open position (not shown). The cap member 102 includes a thumb lever 106 for pivotal movement of the cap member 102 between the closed and open positions. Two support members 108 are affixed to the cap member 102 in complementary positions to the pivot posts 104. Each support member 108 includes a lower portion which has a radiused recess which contact the respective pivot post 104 on the dispenser outlet dispensing body 88 and an upper portion which contacts a boss 110 on the inside of the upper portion of the pump housing 55.

Preferably, the cap member 102 is molded of a polymeric material with an integral biasing member 108. However, it is understood by those skilled in the art from the present disclosure that the cap member 102 can be made from other suitable materials, such as aluminum of other metals, and can utilize a separate spring as a biasing element. Additionally, the configuration of the cap member 102 may be varied, if desired, to suit particular applications.

Having described the structure of the dispenser 10, a brief description of its operation follows with respect to FIGS. 1 and 4*a–c*.

The dispenser 10 is provided with first and second containers 12 and 14. Each container 12 and 14 contains a respective first and second flowable substance (not shown). The flowable substances are preferably a high viscosity gel or paste such as toothpaste. The containers 12 and 14 are attached to the manifold member 30 by threadingly engaging the threads 29 of each container 12 and 14 with the threaded inlet openings 36 and 38 respectively, of the manifold member 30.

In order to use the dispenser 10, the user must first force the flowable substances into the respective first and second manifold chambers 42 and 44. This can be done by manual means such as a user manually forcing the pistons 24 in the respective containers 12 and 14 up. Optionally, the containers 12 and 14 could have a pressurized area beneath the pistons 24 which forces the piston up after the respective container 12 and 14 is releasably attached to the manifold member 30. After the manifold chambers 42 and 44 are filled with the flowable substances, the user then adjusts the selector member 70 by turning the lever 82 to dispense the desired ratio of the first and second substances. As described above, the selector member 70 provides an infinite range of ratios from 100% of the first flowable substance and 0% of the second flowable substance when the selector member is in the first position, as shown in FIG. 4*a*, to 0% of the first flowable substance and 100% of the second flowable substance when the selector member 70 is in the second position, as shown in FIG. 4*c*, to any desired ratio there between when the selector member 70 is in an intermediate position, as shown in FIG. 4*b*.

If the user desires 100% of the first substance and 0% of the second substance, the selector member is adjusted to the position shown in FIG. 4*a*. The user then presses down on the lever 106, pivoting the cap member 102 to open the dispensing outlet 90 and displacing the pump member 50 and the pump actuator 56 in a first direction from the initial, rest position to a second position, as shown in FIG. 2*b*. As the actuator 56 contacts the first flowable substance in the first manifold chamber 42, it is displaced by the actuator 56 and flows into the inlet end 52 of the first portion 60 of the pump member 50, through the opening 84 in the selector member 70 and out the dispenser outlet 90. The actuator 56 also acts on the second flowable substance in the second manifold chamber 44. However, because the selector member 70 is blocking the outlet end 54 of the pump member 50, which is in fluid communication with the second manifold chamber 44, the second flowable substance is forced back into the second container 14 by the pump actuator 56 and compresses the compressible pad 28 on the piston 24.

When the predetermined measure of the first flowable substance has been dispensed, the user releases the lever 106 and the spring 96 biases the pump member 50 toward its initial position. As the dispenser outlet 90 is closed by the cap member 102 and the pump member 50 moves in a second direction with respect to the manifold member 30, opposite to the first direction, a partial vacuum pressure is created in the manifold chambers 42 and 44 causing a predetermined measure of the first flowable substance to be drawn up through the inlet opening 36 in the manifold member 30 and into the first manifold chamber 42. As the first substance is drawn into the first manifold chambers 42, the piston 24 in the first container 12 is drawn upward with the first flowable substance. The vacuum pressure also allows the compressible pad 28 on the piston 24 in the second container 14 to expand so that the second flowable substance is drawn back through the second inlet opening 38 and into the second manifold chamber 44.

If the user desires a mixture of the first and second flowable substances, the selector member 70 is adjusted to a position where the opening 84 is in fluid communication with both manifold chambers 42 and 44. The ratio of the substances being dispensed is in proportion to the percentage of the area of the selector member opening 84 which is in fluid communication with each respective manifold chamber 42 and 44. The process for dispensing the two flowable substances is the same as outlined above. The user presses down on the lever 106 pivoting the cap member 102 to open the dispensing outlet 90 and moving the pump actuator 56 from the initial, rest position to the second position, shown in FIG. 2*b*. As the actuator 56 contacts the first and second flowable substances in the manifold chamber 42 and 44, the first and second flowable substances are displaced by the actuator 56 and flow into the inlet end 52 of the first and second portions 60 and 62 of the pump member 50, through the opening 84 in the selector member 70 and out the dispenser outlet 90.

The compressible pads 28 on the pistons 24 in each container 12 and 14 are compressed in an inverse proportion to the percentage area of the selector member opening 84 in fluid communication with each container 12 or 14. That is, if ratio of the area of the selector member opening 84 is 80% in fluid communication with the first manifold chamber 42 (and the first container 12) and 20% in communication with the second manifold chamber 44 (and the second container 14), the relative ratio of the compression of the compressible pads 28 on the pistons 24 in the first and second containers is 1:4, with the compressible pad 28 in the second container 14 being compressed 4 times as much as the compressible pad 28 in the first container 12. Without the compressible pads 28, the forces exerted by the user would result in higher pressure in the more restricted side of the manifold member 30, and lower pressure on the less restricted side resulting in approximately equal volumes of the flowable substances being dispensed, regardless of the percentage of the selector member opening 84 in fluid communication with the respective manifold chambers 42 and 44. By utilizing the compressible pads 28 to absorb the higher compressive forces in the more restricted side, the resulting pressure operating on the flowable substance in each manifold chamber 42 and 44 is approximately equal. The volumetric displacement of the flowable substances is therefore approximately in direct proportion to the area of the selector opening 84 which is in fluid communication with each respective manifold chamber 42 and 44.

After the predetermined measure of the flowable substances is dispensed, with the amount of each flowable substance being dispensed being in proportion to the area of the opening 84 of the selector member 70 which was in fluid communication with the respective chamber 42 and 44 of the manifold member 30, the lever 106 is released by the user. As the lever 106 is released and the cap member 102 closes the dispensing opening 90, the spring 96 returns the pump member 50 toward its initial position. The partial vacuum pressure created in the manifold number 30 by the return movement of the pump member 50 to the initial, rest position draws additional flowable substance from each respective container 12 and 14 into the manifold chambers 42 and 44. The piston pads 28 are decompressed, and the pistons 24 are drawn toward the dispensing ends 16 and 18 of each respective container 12 and 14.

The process for dispensing 100% of the second flowable substance and 0% of the first flowable substance is similar to the process outlined above for dispensing 100% of the first flowable substance and 0% of the second flowable substance, except the selector member 70 is adjusted with the lever 82 until the selector member opening 84 is in the position shown in FIG. 4*c*.

During the dispensing operation, the flowable substances remain segregated in the manifold chambers 42 and 44 by the manifold member divider 40 and the pump divider 58. As the pump member 50 is moved up and down, the first and second flowable substances may be forced into the slot 41. The grooves 59 in the pump divider 58 allow the first and second flowable substances to be forced back out of the slot 41 as the pump member is depressed.

When a container 12 or 14 is empty, the user unscrews the container 12 or 14 from the respective inlet opening 36 or 38 of the manifold member 30 and replaces it with a new container.

Alternatively, the dispenser 10 may be disposable, with the containers 12 and 14 permanently affixed to the manifold member 30. Upon exhaustion of one of the flowable substances, the dispenser 10 could be discarded.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for dispensing two flowable substances in a user selectable ratio comprising:

a first container for receiving a first flowable substance, the first container having a uniform cross section and including a first, generally open dispensing end and a second end which initially includes a piston which is movable only toward the dispensing end as the flowable substance flows out of the dispensing end;

a second container for receiving a second flowable substance, the second container having a uniform cross section and including a first, generally open dispensing end and a second end which initially includes a piston which is movable only toward the dispensing end as the second flowable substance flows out of the dispensing end;

a manifold member having an inlet end and an outlet end, the inlet end having a pair of inlet openings for removably receiving the dispensing ends of the first and second containers, the manifold member being internally divided by a divider into two chambers, a first chamber being in fluid communication with the dispensing end of the first container, for receiving the first flowable substance, and a second chamber being in fluid communication with the dispensing end of the second container, for receiving the second flowable substance, the outlet end having a pair of outlet openings corresponding to the inlet openings so that the first and second flowable substances from the first and second containers flow into their respective inlet opening, through the respective chambers and out of the respective outlet openings of the manifold member;

a pump member having an inlet end in fluid communication with the first and second manifold chambers and having an outlet end the pump member being movable with respect to the manifold member;

a selector member in fluid communication with the outlet end of the manifold member, the selector member having a single opening of a predetermined size and a predetermined shape extending therethrough, the selector member being selectably rotatable with respect to the outlet end of the manifold member from a first position, in which the selector member opening is in fluid communication with the outlet of the first chamber of the manifold member with the outlet of the second chamber of the manifold member being blocked by the selector member, through a plurality of intermediate positions, in which the opening of the selector member is in fluid communication with portions of the outlets of both of the manifold member chambers with the remaining portions of the outlets of both of the manifold member chambers being blocked by the selector member, to a second position, in which the opening of the selector member is in fluid communication with the outlet of the second chamber of the manifold member and the outlet of the first chamber of the manifold member is blocked by the selector member; and a single dispenser outlet opening in communication with the selector member whereby, upon movement of the pump member by a user in a first direction with respect to the manifold member from an initial, rest position, a predetermined measure of flowable substance is dispensed from the apparatus with the ratio of the flowable substance which constitutes the predetermined measure being selectively variable by the user from one hundred percent of the first flowable substance and zero percent of the second flowable substance when the selector member is in the first position to zero percent of the first flowable substance and one hundred percent of the second flowable substance when the selector member is in the second position to any desired ratio therebetween when the selector member is in an intermediate position and wherein when, upon movement of the pump member in a second direction with respect to the manifold member opposite to the first direction, one or both of the pistons are moved to cause one or both flowable substances to flow into the respective manifold member chambers to thereby fill both of the manifold member chambers with the respective flowable substances.

2. The apparatus as recited in claim 1, further including a biasing member for biasing the pump member toward the initial rest position.

3. The apparatus of claim 1 further comprising a compressible member located on the first and second pistons.

4. The apparatus of claim 3 wherein the pump member includes an actuator having a determined volumetric displacement.

5. The apparatus of claim 4 wherein each compressible member has a volume which is approximately equal to at least 50% of the volumetric displacement of the pump member.

6. The apparatus of claim 1 wherein the pump member further comprises a pump divider located in the pump member which divides the pump member into first and second portions, and the pump divider is in overlapping contact with the manifold divider.

7. The apparatus of claim 6 wherein the manifold divider includes a slot, and the pump divider is slidably disposed in the slot.

8. The apparatus of claim 1 further comprising a cap member located on the dispenser outlet opening, the cap member being pivotally mounted for movement between a first, closed position, where it blocks the dispenser outlet opening and a second open position.

9. The apparatus of claim 1 further comprising a compressible member associated with each manifold chamber.

10. An apparatus for dispensing two flowable substances in a user selectable ratio comprising:

a first container having a first, dispensing end and a second end;

a piston disposed in the second end, the piston being movable only toward the dispensing end;

a second container having a first, dispensing end and a second end;

a second piston disposed in the second end of the second container, the second piston being movable only toward the dispensing end;

a manifold member including;

an inlet end and an outlet end, the inlet end having first and second inlet openings for removably receiving the dispensing ends of the first and second containers, respectively, a manifold divider located in the manifold which divides the manifold into first and second chambers, the first chamber being in fluid communication With the outlet of the first container, and the second chamber being in fluid communication with the outlet of the second container, first and second manifold outlet openings at the outlet end, the first manifold outlet opening being in fluid communication with the first chamber, and the second manifold outlet opening being in fluid communication with the second chamber;

a pump member slidably disposed in the outlet end of the manifold member and having an outlet end;

a selector member in fluid communication with the first and second manifold outlet openings;

an opening of a predetermined size extending through the selector members such that the selector member is rotatably positionable relative to the manifold member from a first position, in which the selector member opening is in fluid communication with the outlet of the first chamber of the manifold member with the outlet of the second chamber of the manifold member being blocked by the selector member, through a plurality of intermediate positions, in which the opening of the selector member is in fluid communication with portions of the outlets of both of the manifold member chambers with the remaining portions of the outlets of both of the manifold member chambers being blocked by the selector member, to a second position, in which the opening of the selector member is in fluid communication with the Outlet of the second chamber of the manifold member and the outlet of the first chamber of the manifold member is blocked by the selector member; and a dispenser outlet opening in fluid communication with the selector member.

11. The apparatus of claim 10, further including a biasing member for biasing the pump member toward an initial, rest position.

12. The apparatus of claim 10 further comprising a compressible member located on the first and second pistons.

13. The apparatus of claim 12 wherein the pump member includes an actuator having a determined volumetric displacement.

14. The apparatus of claim 13 wherein each compressible member has a volume which is approximately equal to at least 50% of the volumetric displacement of the pump member.

15. The apparatus of claim 10 wherein the pump member further comprises a pump divider located in the pump member which divides the pump member into first and second portions, and the pump divider is in overlapping contact with the manifold divider.

16. The apparatus of claim 15 wherein the manifold divider includes a slot, and the pump divider is slidably disposed in the slot.

17. The apparatus of claim 10 further comprising a cap member located on the dispenser outlet opening, the cap member being pivotally mounted for movement between a first, closed position, where it blocks the dispenser outlet opening and a second open position.

18. The apparatus of claim 10 further comprising a compressible member associated with each manifold chamber.

* * * * *